US008199963B2

(12) United States Patent
Schrank

(10) Patent No.: US 8,199,963 B2
(45) Date of Patent: Jun. 12, 2012

(54) MICROPHONE ARRANGEMENT AND METHOD FOR PRODUCTION THEREOF

(75) Inventor: Franz Schrank, Handelsstr (AT)

(73) Assignee: austriamicrosystems AG, Unterpremstätten (AT)

( * ) Notice: Subject to any disclaimer, the term of this patent is extended or adjusted under 35 U.S.C. 154(b) by 1246 days.

(21) Appl. No.: 11/973,224

(22) Filed: Oct. 5, 2007

(65) Prior Publication Data

US 2008/0137886 A1 Jun. 12, 2008

(30) Foreign Application Priority Data

Oct. 5, 2006 (DE) ..... 10 2006 047 203

(51) Int. Cl.
*H04R 11/02* (2006.01)
*H01L 21/00* (2006.01)

(52) U.S. Cl. ..... 381/423; 438/53

(58) Field of Classification Search ..... 381/174, 381/337, 423–425; 367/178–188; 438/50–53; 257/415–420, E29.324, E21.613
See application file for complete search history.

(56) References Cited

U.S. PATENT DOCUMENTS 5,490,220 A 2/1996 Loeppert
5,856,914 A 1/1999 O'Boyle
6,088,463 A 7/2000 Rombach et al.
6,156,585 A * 12/2000 Gogoi et al. ..... 438/48
6,486,534 B1 11/2002 Sridharan et al.
6,535,460 B2 * 3/2003 Loeppert et al. ..... 367/181
6,732,588 B1 5/2004 Mullenborn et al.
6,829,814 B1 * 12/2004 Freeman et al. ..... 29/594
6,847,090 B2 * 1/2005 Loeppert ..... 257/418
2002/0106828 A1 8/2002 Loeppert
2005/0095813 A1 5/2005 Zhu et al.

FOREIGN PATENT DOCUMENTS

DE 102004058879 A1 6/2006
EP 1244332 A2 9/2002
WO WO 03/038449 A1 5/2003
WO WO 03/045110 A1 5/2003
WO WO 2004/008522 1/2004

OTHER PUBLICATIONS

"CMOS Process Flow", San Jose State University, EE/MatE 129, Basic IC Processing and Design, Fall 2006, pp. 1-3.
Plummer et al., "CMOS Technology—Chapter 2", Silicon VLSI Technology, 2000, USA, pp. 1-18.

* cited by examiner

*Primary Examiner* — Calvin Lee
(74) *Attorney, Agent, or Firm* — Cozen O'Connor

(57) ABSTRACT

A microphone arrangement comprises a stack arrangement (1) which comprises a first semiconductor body (10) having a microphone structure (13) and a second semiconductor body (80). The second semiconductor body (80) comprises a first main face (81) on which an integrated circuit (83) is arranged and a second main face (82) which faces the first semiconductor body (10).

14 Claims, 12 Drawing Sheets

MICROPHONE ARRANGEMENT AND METHOD FOR PRODUCTION THEREOF

RELATED APPLICATION

This patent application claims the priority of German patent application no. 10 2006 047 203.9 filed Oct. 5, 2006, the disclosure content of which is hereby incorporated by reference.

FIELD OF THE INVENTION

The present invention relates to a microphone arrangement and to a method for producing a microphone arrangement.

BACKGROUND OF THE INVENTION

Microphone arrangements are used in mobile radio communication appliances and landline communication appliances. Furthermore, they are used in dictaphones, safety devices and photoacoustic gas analyzers, for example. Microphone arrangements can be produced in the form of microsystems engineering components, or micro-electro-mechanical systems, using microtechniques.

SUMMARY OF THE INVENTION

According to an embodiment of the invention, a microphone arrangement comprises a stack arrangement. The stack arrangement has a first and a second semiconductor body. The first semiconductor body comprises a microphone structure. The second semiconductor body has a first and a second main face. The first main face of the second semiconductor body comprises an integrated circuit. The second main face of the second semiconductor body is connected to the first semiconductor body.

One advantage of the proposed stack arrangement is that the microphone structure and the integrated circuit can each be produced using separate production methods optimized for production. This achieves a high yield and hence very good cost efficiency. Another advantage of the stack arrangement is that it can be used to produce a microphone arrangement having a small base area. This allows simple fitting of the microphone arrangement. The stack arrangement comprising two semiconductor bodies can advantageously be used to produce a stiff construction, so that any influence by tensions, such as may be brought about by temperature changes, on the microphone structure can be kept down.

The microphone structure can be produced as an MEMS component using microtechniques. The integrated circuit can be produced using a bipolar integration technique. Alternatively, the integrated circuit can be produced using a complementary metal-oxide semiconductor integration technique, CMOS integration technique for short.

In one embodiment, the first semiconductor body has a first and a second main face. Preferably, the first main face of the first semiconductor body is arranged parallel to the second main face of the first semiconductor body. Similarly, the first main face of the second semiconductor body is preferably arranged parallel to the second main face of the second semiconductor body. Preferably, the two main faces of the first semiconductor body are arranged parallel to the two main faces of the second semiconductor body.

The first and second semiconductor bodies are permanently connected to one another. This may mean that the first main face of the first semiconductor body and the second main face of the second semiconductor body are permanently connected to one another directly or via intermediate layers. Alternatively, it may mean that the first main face of the first semiconductor body and the second main face of the second semiconductor body are permanently connected to one another spaced apart by means of further bodies.

In one embodiment, the first semiconductor body comprises a recess which is arranged between the first and second main faces of the first semiconductor body. The microphone structure comprises mechanical structures and the recess.

In one embodiment, the microphone structure is arranged on the first main face of the first semiconductor body. The first main face of the first semiconductor body faces the second semiconductor body. This has the advantage that a medium can emerge from the second main face in contact with the microphone structure in order to determine a soundwave.

In one embodiment, the second semiconductor body has an electrically conductive plated-through hole between the first main face and the second main face. The plated-through hole can connect a connection on the first main face of the second semiconductor body to a connection on the microphone structure. In one development, the plated-through hole comprises an electrically conductive layer which is insulated from a substrate of the first and second semiconductor bodies. It is also insulated from a surface of the first and second semiconductor bodies apart from at connecting points. The second semiconductor body may comprise at least one further plated-through hole. The plated-through holes may have approximately the same length. Alternatively, the plated-through holes may have at least two different lengths. Hence, interconnects arranged in different layers of the microphone structure can advantageously be connected to the first main face of the second semiconductor body and hence to the integrated circuit.

In one embodiment, the stack arrangement has a support. The second semiconductor body may be arranged on the support. Preferably, the first main face of the second semiconductor body is connected to the support. The first main face of the second semiconductor body may have connections and further means provided on it which are used for electrically connecting connections on the first main face of the second semiconductor body to connections on the support. The further means may comprise bond balls. The second semiconductor body can therefore be housed using a flip-chip technique. The bond balls can also be called solder balls or metal bumps. The support may be a printed circuit board. For mechanical stabilization, an adhesive, or underfiller, can be introduced into the interspace between the second semiconductor body and the support. The stack arrangement of the first and the second semiconductor body and the support results in a compact and cost effective system. Thus, the integrated circuit on the first main surface of the second semiconductor body may advantageously be protected by the stack arrangement. Connections on the first main face of the second semiconductor body may be connected to connections on the support without bonding wires.

The microphone structure may have a capacitive structure for detecting sound. In one embodiment, the capacitive structure comprises two electrodes. In one embodiment, one of the electrodes is in the form of a plate and is held just at the edge by means of connections from the plate to the microphone structure and to the first semiconductor body. In one embodiment, the first electrode is in the form of a stiff and stiffly suspended electrode and the second electrode is in the form of a freely positioned, flexible electrode. The second electrode may be capable of oscillating. The second electrode is arranged so as to oscillate freely in a free volume on both sides. In one development, the second electrode has a lesser thickness than the first electrode. A measurement result is primarily dependent on the size of the plates and the distance between the two electrodes, which is influenced by the sound pressure.

In one embodiment, the stiff electrode comprises recesses through which a medium which is influenced by the sound pressure can flow. The recesses in the stiff electrode may be provided in the form of sound entry openings. Since the stiff electrode is in a fixed position relative to the first semiconductor body and the flexible electrode is in a position which changes relative to the first semiconductor body on the basis of the sound pressure, sound information can be obtained from the distance between the fixed and the flexible electrode.

In one embodiment, the microphone structure may comprise a spacer or a stop which is arranged between the two electrodes. The stop advantageously comprises a nonconductive material. In one embodiment, the spacer or the stop is permanently connected to both electrodes. In one preferred embodiment, the stop is permanently connected to just one of the two electrodes, so that the other of the two electrodes can move relative to the stop. The stop is used to stipulate a minimum distance d between the two electrodes. Advantageously, it is therefore possible to prevent a short between the two electrodes. A plurality of stops may be provided.

The fixed and/or the free electrode can be produced from a monocrystalline material. Preferably, the fixed and the flexible electrode are produced from a polycrystalline material. The first and/or the second semiconductor body may have silicon as the base material. The crystalline material may be silicon. The polycrystalline material may preferably be polysilicon.

According to an embodiment, a method for producing a microphone arrangement provides the following steps: to produce a microphone structure, a first semiconductor body is used. An integrated circuit is produced on a first main face of a second semiconductor body. The first and second semiconductor bodies are connected to one another. A stack arrangement is formed from the first and second semiconductor bodies such that a second main face of the second semiconductor body faces the first semiconductor body.

It is thus advantageously possible to produce the microphone structure using a production technique which is optimized for such a production process. For example, microtechniques for producing an MEMS microphone structure may be provided.

The microphone structure can be produced using a thin film technique. To this end, the first semiconductor body can be provided as a support. A first and a second electrode of a capacitive microphone structure can be produced in a thin layer design. In this context, the thin layer design may have further layers arranged on both sides of the first electrode and on both sides of the second electrode and hence also between the first and the second electrode. Removal of the further layers exposes the two electrodes. Such layers are called sacrificial layers.

In one development, the first and second electrodes of the microphone structure are exposed in one method step. In one preferred embodiment, the two electrodes are exposed using a first and a second method step. A portion of the second electrode is exposed in the first method step, which is provided before the first and second semiconductor bodies are connected. The second method step for the exposure is provided after the first and second semiconductor bodies have been connected.

In one embodiment, the microphone structure is produced to wafer scale on the first semiconductor body, and the integrated circuit is produced to wafer scale on the second semiconductor body, and then the first and second semiconductor bodies are connected as wafers to one another to form a stack arrangement. In one embodiment, the first and second main faces of the first semiconductor body have the same value as the first and second main faces of the second semiconductor body. In one embodiment, the two main faces of the first semiconductor body have the same value for a length and the same value for a width as the two main faces of the second semiconductor body. By way of example, a microphone arrangement of this kind can be produced by sawing wafers from a stack arrangement which comprises a wafer with the first semiconductor body and a wafer with the second semiconductor body.

In one embodiment, production of the stack arrangement on the first and second semiconductor bodies is followed by production of individual microphone arrangements using a sawing step.

In one embodiment, the microphone arrangement singularized in this manner is connected to a support. In an embodiment, the first main face of the second semiconductor body is connected to the support. Thus, the first and the second semiconductor body and the support form the stack arrangement.

DETAILED DESCRIPTION OF THE DRAWINGS

Figure 1A:
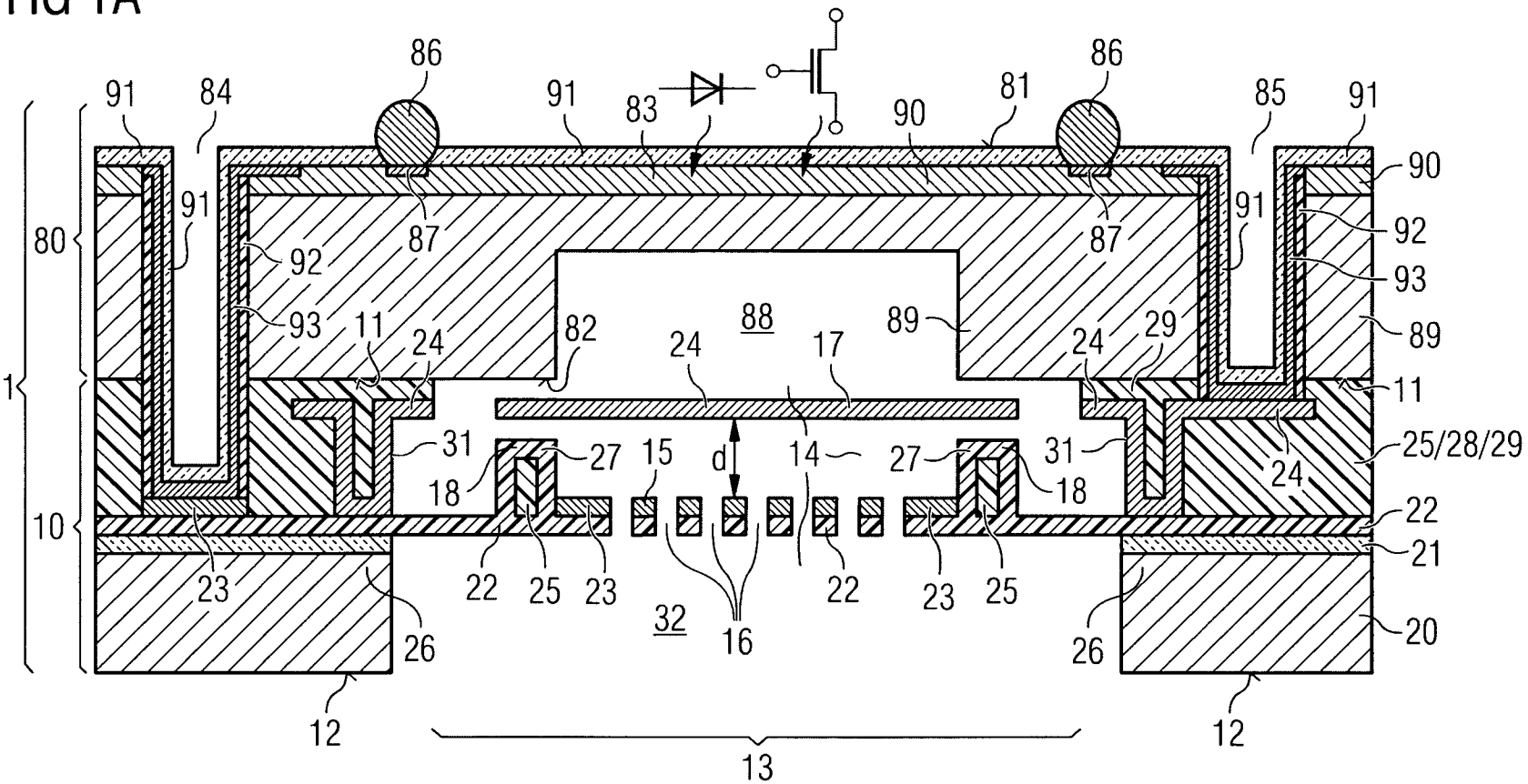
FIGS. 1A and 1B show exemplary embodiments of microphone arrangements in accordance with the invention.

FIG. 1A shows an exemplary embodiment of a microphone arrangement which comprises a stack arrangement 1 comprising a first semiconductor body 10 and a second semiconductor body 80. The first semiconductor body 10 has a first main face 11, which faces the second semiconductor body 80, and a second main face 12. The first semiconductor body 10 comprises a microphone structure 13 which is arranged in a recess 14. The first semiconductor body 10 has a substrate 20 which defines the recess 14. The substrate 20 is in the form of monocrystalline silicon. The substrate 20 has a first insulator layer 21 deposited on it. The first insulator layer is produced as undoped silicon dioxide having a thickness of approximately 1 micron. The first insulator layer 21 has a second insulator layer 22 deposited on it. The second insulator layer 22 may comprise silicon nitride and exhibit a thickness of 0.5 micron. The second insulator layer has a first conductive layer 23 deposited over it. The first conductive layer 23 is in the form of a polysilicon layer. It is situated on the second insulator layer in the area of the microphone structure within the recess 14 and is connected to a point below a plated-through hole 84. The first conductive layer 23 and the second insulator layer 22 have openings 16. A second conductive layer 24 is deposited at a distance d. This is likewise in the form of a polysilicon layer. The second conductive layer 24 forms a second electrode of the capacitive structure of the microphone structure 13. A first electrode 15 comprises the first conductive layer 23. The first electrode 15 and the second electrode 17 have a stop 18 provided between them. The stop 18 comprises a third and a fourth insulator layer 25, 27 as material. The two insulator layers 25, 27 are also called sacrificial layers and comprise P-doped silicon dioxide. The first electrode 15 is suspended on the frame 26. The second electrode 17 is likewise connected to the frame 26 at points which are not shown in FIG. 1A. The area of the frame 26 contains the third, fifth and sixth insulator layers 25, 28, 29 on the second insulator layer 22.

The second semiconductor body 80 comprises a first main face 81 and a second main face 82. The second main face 82 is arranged directly on the first main face 11 of the first semiconductor body 10. The second semiconductor body 80 comprises a substrate 89 which extends up to the second main face 82. The substrate 89 is in the form of monocrystalline silicon. In addition, the semiconductor body 80 comprises an active layer 90 in which an integrated circuit 83 is implemented. The integrated circuit 83 evaluates the sound-pressure-dependent capacitance values of the capacitive structure of the microphone structure 13 which comprises the first and second electrodes 15, 17.

The active layer 90 is covered by a passivation layer 91 and is therefore protected. The passivation layer 91 contains openings which allow contact with connections 87. The connections 87 have bond balls 86 arranged on them. The second semiconductor body 80 has the first plated-through hole 84 and a second plated-through hole 85. To produce the two plated-through holes 84, 85, recesses are provided in the second semiconductor body 80. The recesses extend from the first main face 81 to the second main face 82 of the second semiconductor body 80. The substrate in the area of the recesses is covered by an insulation layer 92. The insulation layer 92 has a metallization layer 93 above it. The metallization layer 93 of the first plated-through hole 84 connects the first conductive layer 23 of the first electrode 15 to the active layer 90. Similarly, the metallization layer 93 of the second plated-through hole 85 connects the second conductive layer 24 of the second electrode 17 likewise to the active layer 90. The integrated circuit 83 is supplied with electrical power by means of the connections 87 and the bond balls 86 and uses these connections 87 and the bond balls 86 to output signals which comprise information about the sound pressure. The second semiconductor body 80 has a recess 88 which is arranged in the area of the microphone structure 13 of the first semiconductor body 10. The recess 88 allows the flexible electrode 17 to move in the direction of the second semiconductor body 80. The recess 88 is also used as a reservoir for pressure equalization.

The medium in which the sound pressure is to be measured has access to the recess 14 in the first semiconductor body 10 and hence to the microphone structure 13. Since the first electrode 15 is made up of two layers, namely the second insulator layer 22 and the first conductive layer 23, and is clamped on all sides by means of connections to the frame 26, it is provided as a rigid electrode. The recess 14 allows the medium to flow into and out of the recess 88 in the second semiconductor body 80. The effect achieved by the recesses 16 is that the pressure on the two sides of the first electrode 15 is approximately equal, so that the first electrode 15 does not move but rather has a fixed position relative to the frame 26 of the first semiconductor body 10. The second electrode 17 is made up exclusively of one layer, namely the second conductive layer 24, and is more flexible than the first electrode 15. The second electrode 17 does not have a recess, which means that a pressure difference appears at least intermittently on the two sides of the second electrode 17, said pressure difference resulting in movement of the second electrode 17 in the direction of the first electrode 15 or in the opposite direction. The distance d between the first and second electrodes 15, 17 can therefore be used to obtain information about the sound pressure. The medium can flow around the second electrode 17 and enter the recess 88 in the second semiconductor body 80. Since this can be carried out only in the areas of the openings which are provided between the second electrode 17 and the frame 26, however, this pressure equalization occurs only slowly, which means that rapid pressure changes such as the sound pressure result in deflection of the second electrode 17. The two electrodes 15, 17 form a capacitor and are connected to the active layer 90 of the integrated circuit 83 via the two plated-through holes 84, 85. In the integrated circuit 83, the capacitance value provided by means of the two electrodes 15, 17 is converted into a current or voltage signal. Alternatively, the capacitance value is converted into a digital signal. Advantageously the second semiconductor body 80 is thinned, so that the length of the plated-through hole is short and hence the stray capacitance between the metallization layer 93 of the two plated-through holes 84, 85 and the substrate 89 of the second semiconductor body 80 is low.

In one alternative embodiment (not shown), the second semiconductor body 80 comprises at least one further plated-through hole.

Figure 1B:
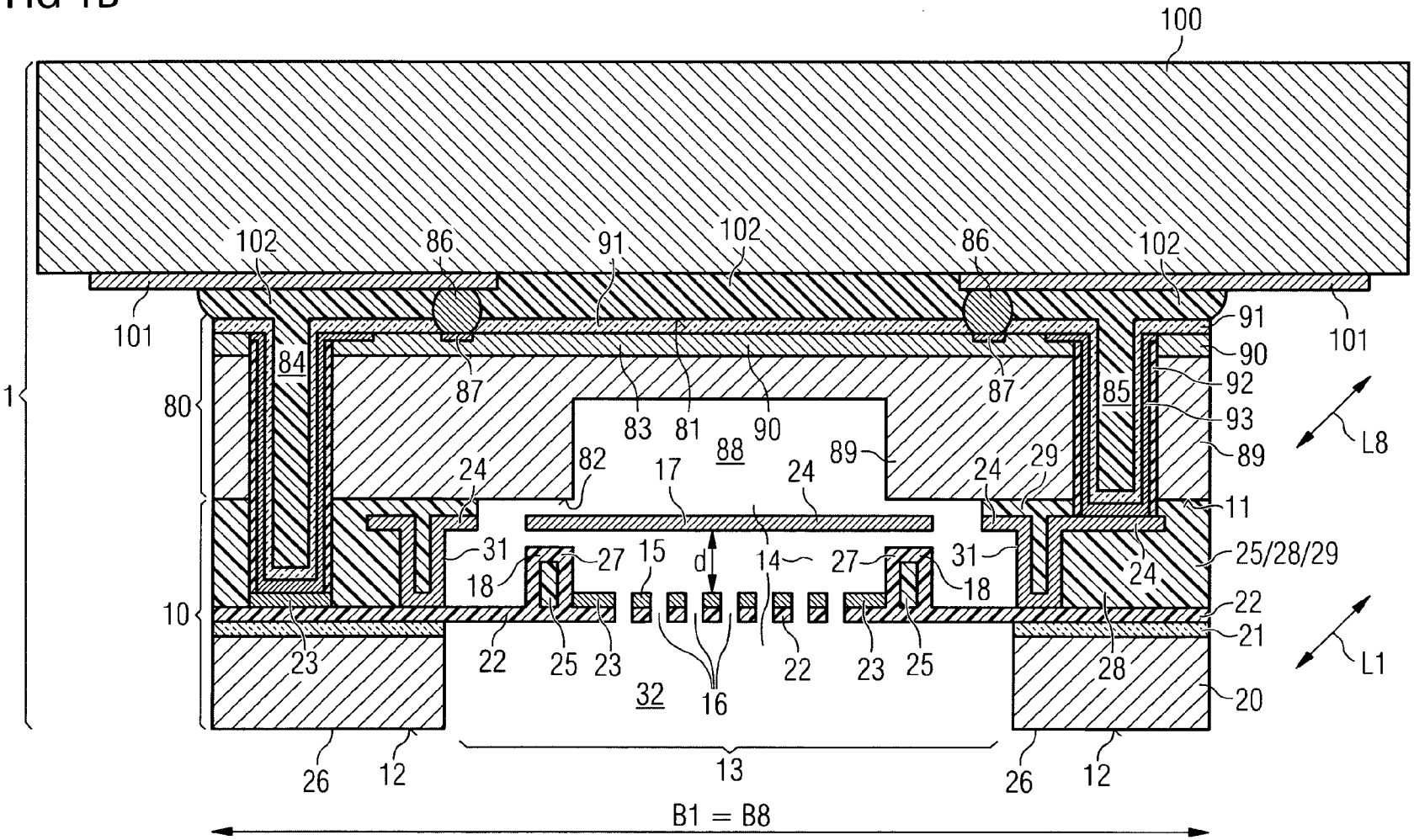

FIG. 1B shows an exemplary microphone arrangement having a stack arrangement 1, which is a development of the microphone arrangement shown in FIG. 1A. The stack arrangement 1 shown in FIG. 1B comprises the first and second semiconductor bodies 10, 80 and also a support 100. The support 100 has connections 101. The connections 101 are arranged over the bond balls 86. Hence, the connections 87 of the integrated circuit 81 are connected to the connections 101 on the support 100 by means of the bond balls 86. The support 100 and the first main face 81 of the second semiconductor body 80 have an insulating material 102 provided between them. The insulating material 102, also called underfiller, is used for mechanical stabilization of the connection between the support 100 and the second semiconductor body 80. The microphone arrangement can therefore be put on using flip-chip technology.

Figure 2A:
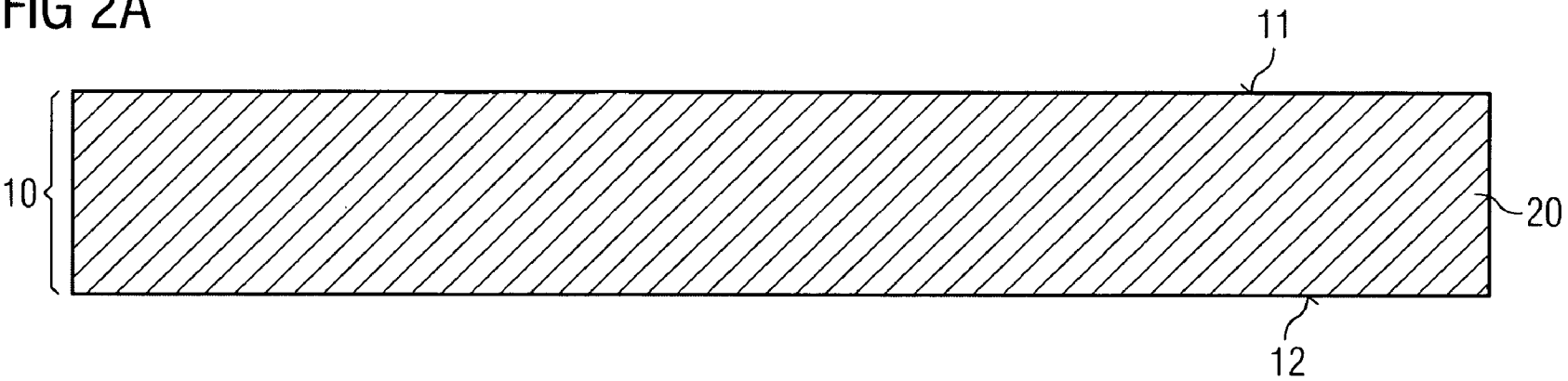
FIGS. 2A to 2O show an exemplary method for producing a microphone arrangement in accordance with the invention.

FIGS. 2A to 2O show an exemplary embodiment of a method for producing the microphone arrangement. FIG. 2A shows the substrate 20 of the first semiconductor body 10 with the first and second main faces 11, 12. The substrate 20 is in the form of a silicon wafer.

Figure 2B:
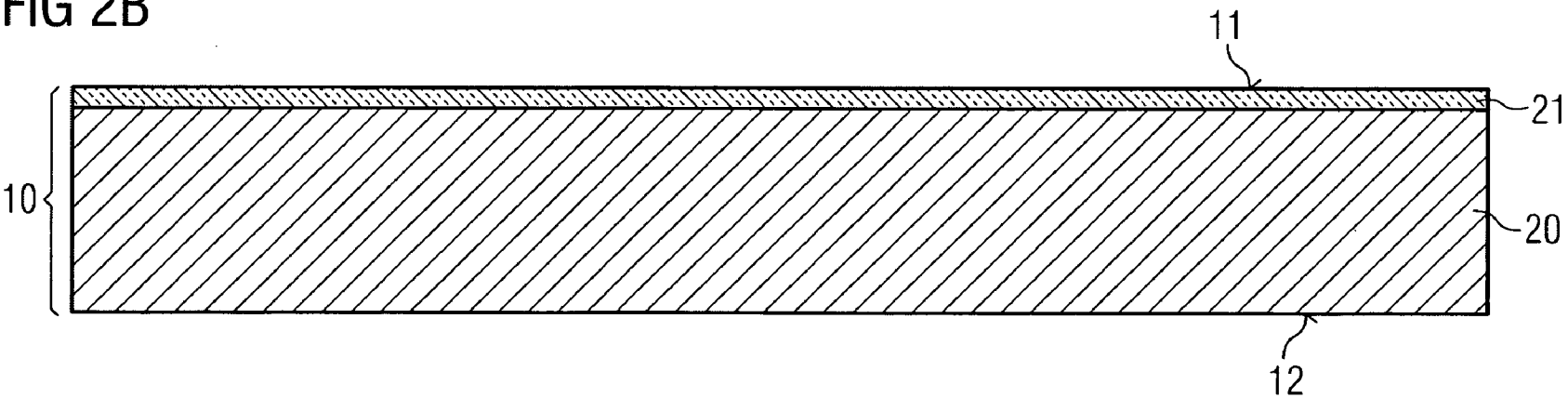

FIG. 2B shows the first semiconductor body 10 with a first insulator layer 21 on the first main face 11. The first insulator layer 21 is deposited on the substrate 20. It is an undoped silicon dioxide layer with a thickness of approximately 1 μm. Alternatively, the first insulator layer 21 is produced by means of thermal oxidation.

Figure 2C:
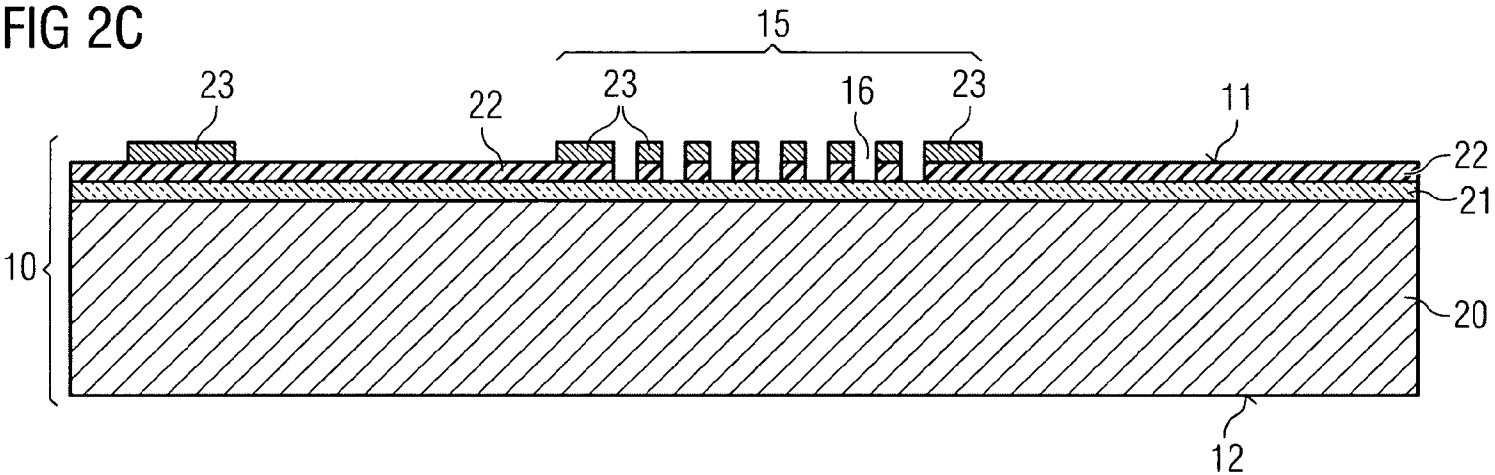

FIG. 2C shows the first semiconductor body 10 with a second insulator layer 22, which is deposited on the first insulator layer 21, and with a first conductive layer 23, which is deposited on the second insulator layer 22. The second insulator layer 22 is in the form of a nitride layer. This is a stoichiometric nitride layer with a thickness of approximately 0.5 μm. The first conductive layer 23 is in the form of a polysilicon layer. In a first step, a photographic technique is used to structure the first conductive layer 23, so that it is removed in the areas which are not part of the first electrode 15 and the connection of the first electrode 15 in the area of the first plated-through hole 84. A further photographic technique is used to produce the recesses 16 in the first conductive layer 23 and in the second insulator layer 22 in a second step.

Figure 2D:
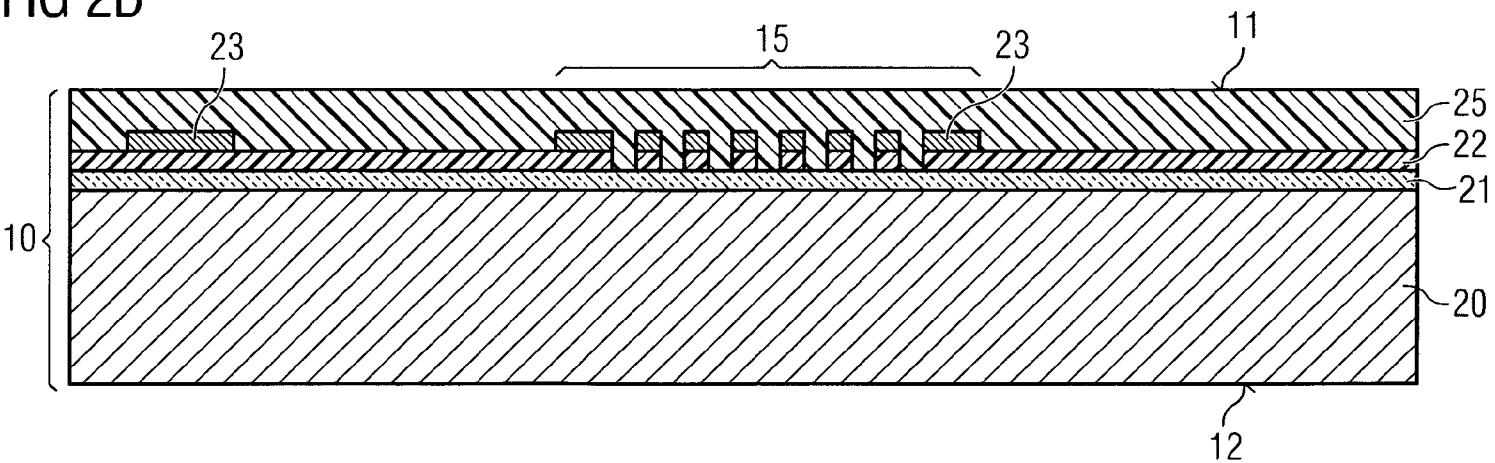

FIG. 2D shows the first semiconductor body 10, in which a third insulator layer 25 has been deposited on the first main face 11. The third insulator layer 25 is called a sacrificial layer. It is in the form of a Pdoped silicon dioxide layer. The thickness of the third insulator layer 25 is greater than the sum of the thicknesses of the first and second insulator layers 21, 22. The recesses 16 are therefore filled by the third insulator layer 25. Following deposition of the third insulator layer 25, a planarization step takes place. This is carried out using a chemical-mechanical polishing step, CMP for short.

In one alternative embodiment, the third insulator layer 25 may be an undoped silicon dioxide layer.

Figure 2E:
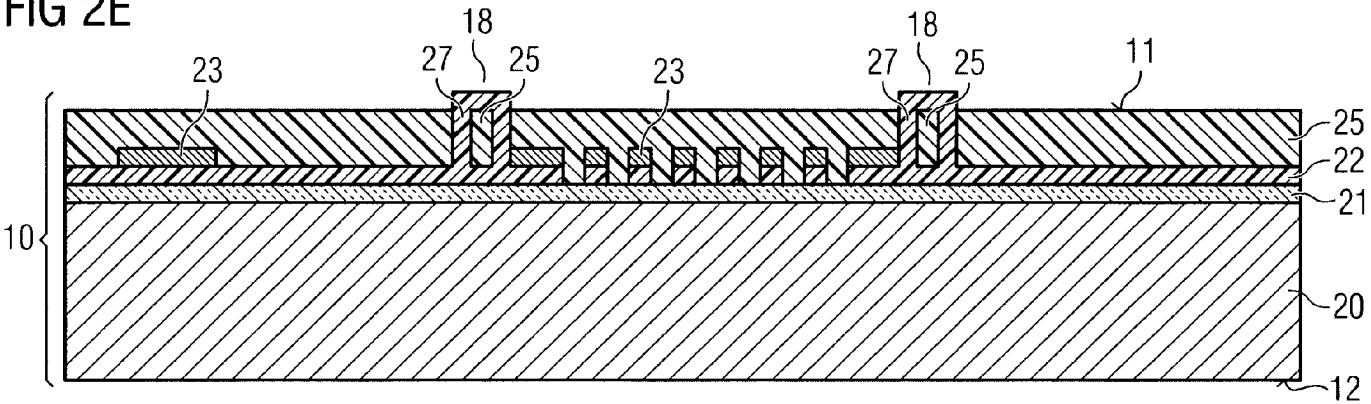

FIG. 2E shows two stops 18, which are also called anchor structures. To produce the stops 18, a mask technique is first of all used to etch recesses into the third insulator layer 25. Next, the recesses are filled up by means of a fourth insulator layer 27. The fourth insulator layer 27 is in the form of a nitride layer. In a further photographic step, the fourth insulator layer 27 is structured such that it occurs exclusively in the area of the two stops 18 and is otherwise removed on the first main face 11.

Figure 2F:
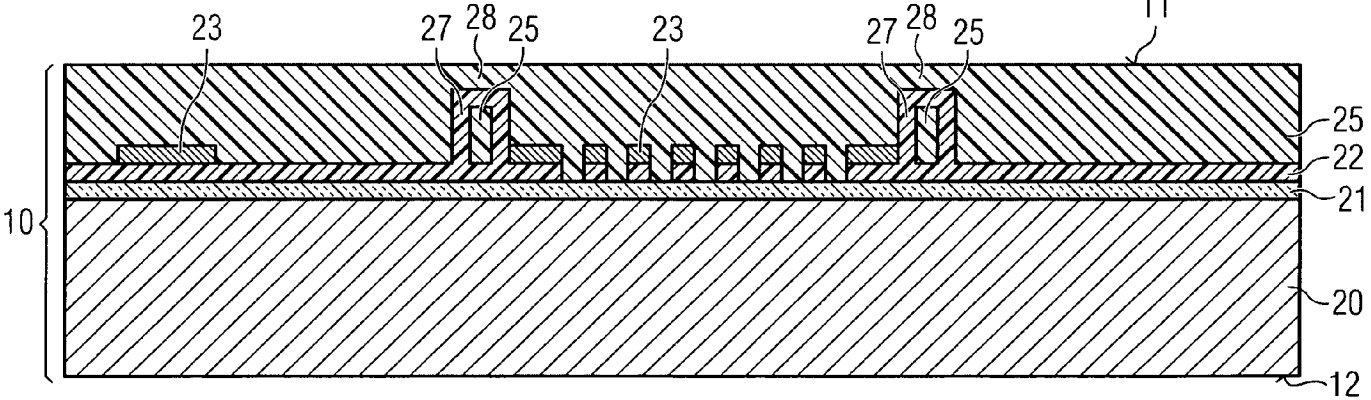

FIG. 2F shows the first semiconductor body 10 after a fifth insulator layer 28 has been put on and a planarization step. This is carried out using a CMP method. The fifth insulator layer 28 is in the form of a silicon oxide layer. Since the insulator layer 28 therefore has the same composition as the third insulator layer 25, it is shown in FIG. 2F and subsequently not as a separate layer but rather as one layer together with the third insulator layer 25.

Figure 2G:
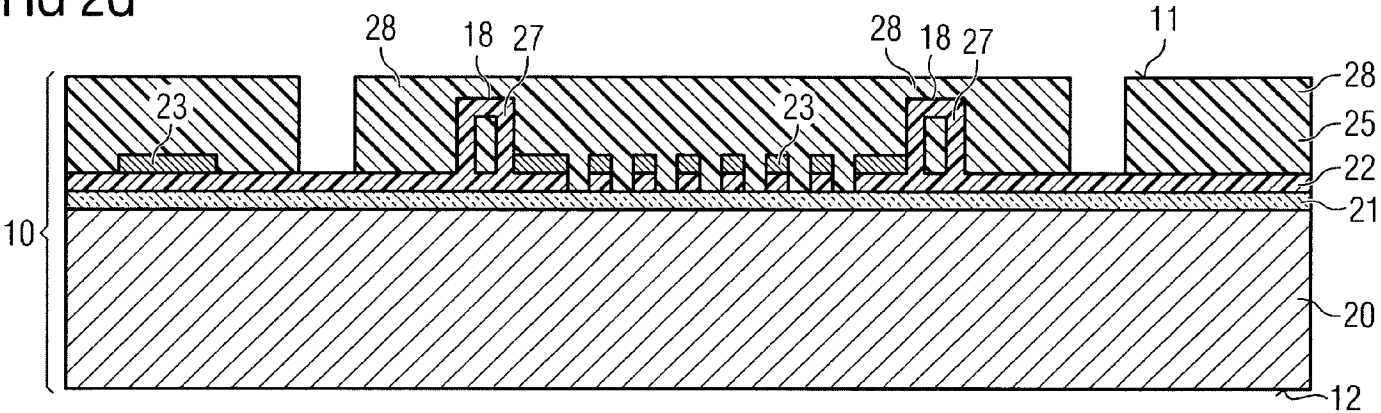

FIG. 2G shows the first semiconductor body 10 after recesses have been etched in the third and fifth insulator layers 25, 28.

Figure 2H:
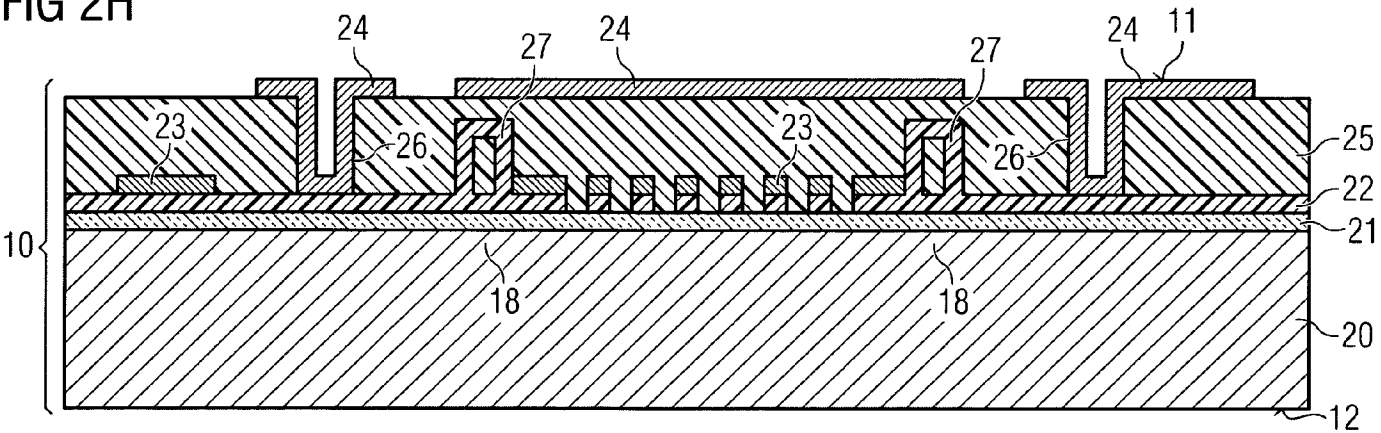

FIG. 2H shows the first semiconductor body 10 after a second conductive layer 24 has been deposited. The second conductive layer 24 is in the form of a polysilicon layer. As shown by FIG. 2H, the second conductive layer 24 has been etched away in areas which are not part of the second electrode and a structure which bounds the frame 26.

Figure 2I:
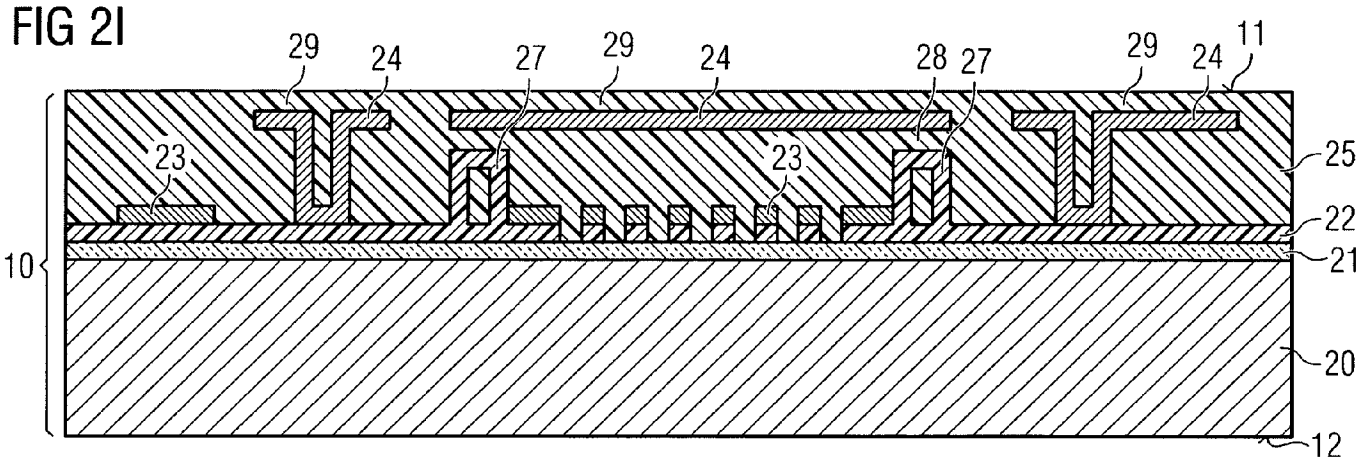

FIG. 2I shows the first semiconductor body 10 after a sixth insulator layer 29 has been deposited and a planarization step. This is carried out using a CMP method. The sixth insulator layer 29 is in the form of a silicon oxide layer and has the same composition as the third and fifth insulator layers 25, 28. It is therefore not shown separately from these two other insulator layers 25, 28.

Figure 2J:
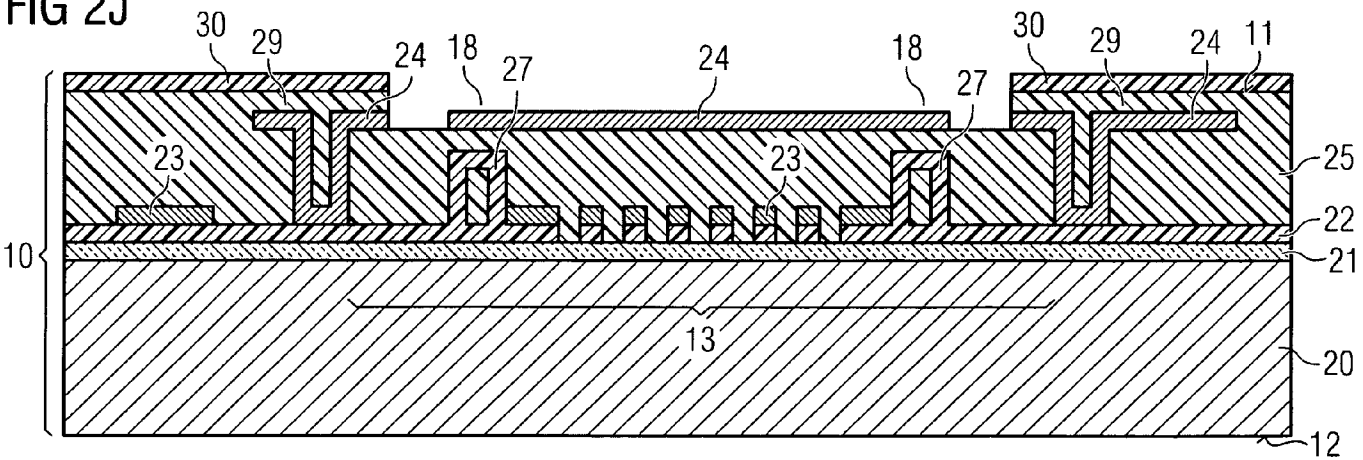

FIG. 2J shows the first semiconductor body 10 while a further photographic step is being carried out. The first main face 11 has a photoresist 30 deposited onto it which is removed in the area of the microphone structure 13 following the exposure and development step of the photographic step. The photoresist 30 is used as an etching mask in the step of removing the sixth insulator layer 29 above the second electrode 17. This etching operation can take place using a dry etching process or by wet chemical means. Hence, a first method step is carried out in which a portion of the sacrificial layers is removed.

Further process steps also use photoresist layers and carry out photographic steps. For reasons of clarity, these photoresist layers have not been shown, however.

Figure 2K:
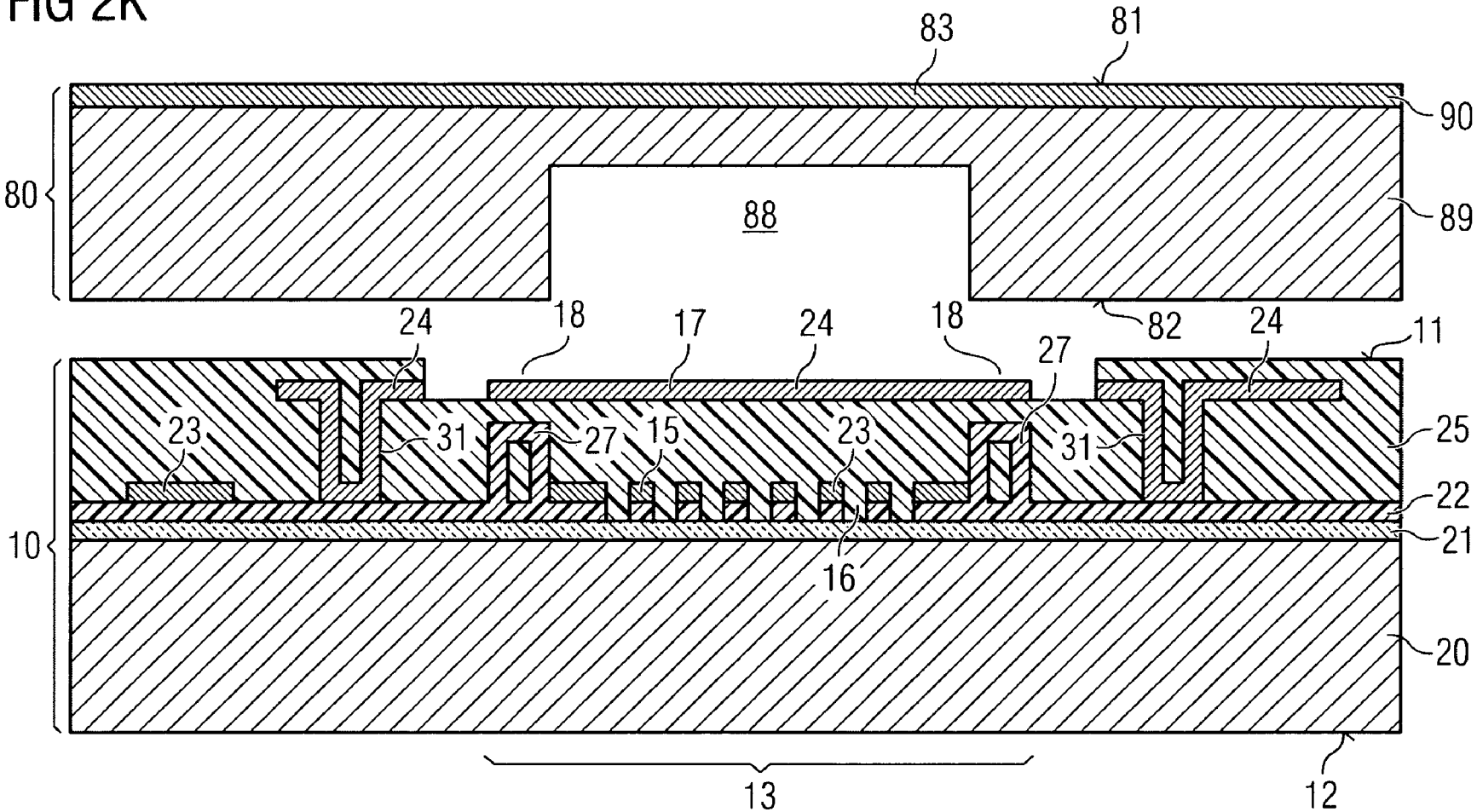

FIG. 2K shows the first semiconductor body 10 following removal of the photoresist 30 and also the second semiconductor body 80. The second semiconductor body 80 comprises the first main face 81 and the second main face 82. Method steps which are not shown are used to produce the active layer 90 which has the integrated circuit 83 on the first main face 81 of the second semiconductor body 80. FIG. 2K shows the second semiconductor body 80 already in the thinned state. The area of the microphone structure 13 has a recess 88 etched into the second semiconductor body 80, said recess extending from the second main face 82 into the substrate 89. The recess 88 is produced in a dry etching process. Alternatively, the recess 88 can also be produced in a wet chemical etching process by means of anisotropic etching, in which instead of the 90 degree angles of the recess 88 the angles known from micromechanics occur.

The active layer 90 with the integrated circuit 83 can be produced according to the general knowledge of a person skilled in the art. In an exemplary embodiment, the steps comprise realization of a well, local oxidation of silicon (LOCOS), oxidation of a gate oxide, deposition of a gate polysilicon layer, realization of a spacer and implantation of a source- and a drain-region. The active layer 90 can for example be produced in accordance with the process steps described in Chapter II of the publication Silicon VSLI Technology, Fundamentals, Practice and Modeling by Plummer, Deal and Griffin (Prentice Hall© 2000), which is incorporated by reference herein. Optionally, the process steps comprise a deposition of a further polysilicon layer. The further polysilicon layer may for example be used for the realization of resistors and/or capacitors.

Figure 2L:
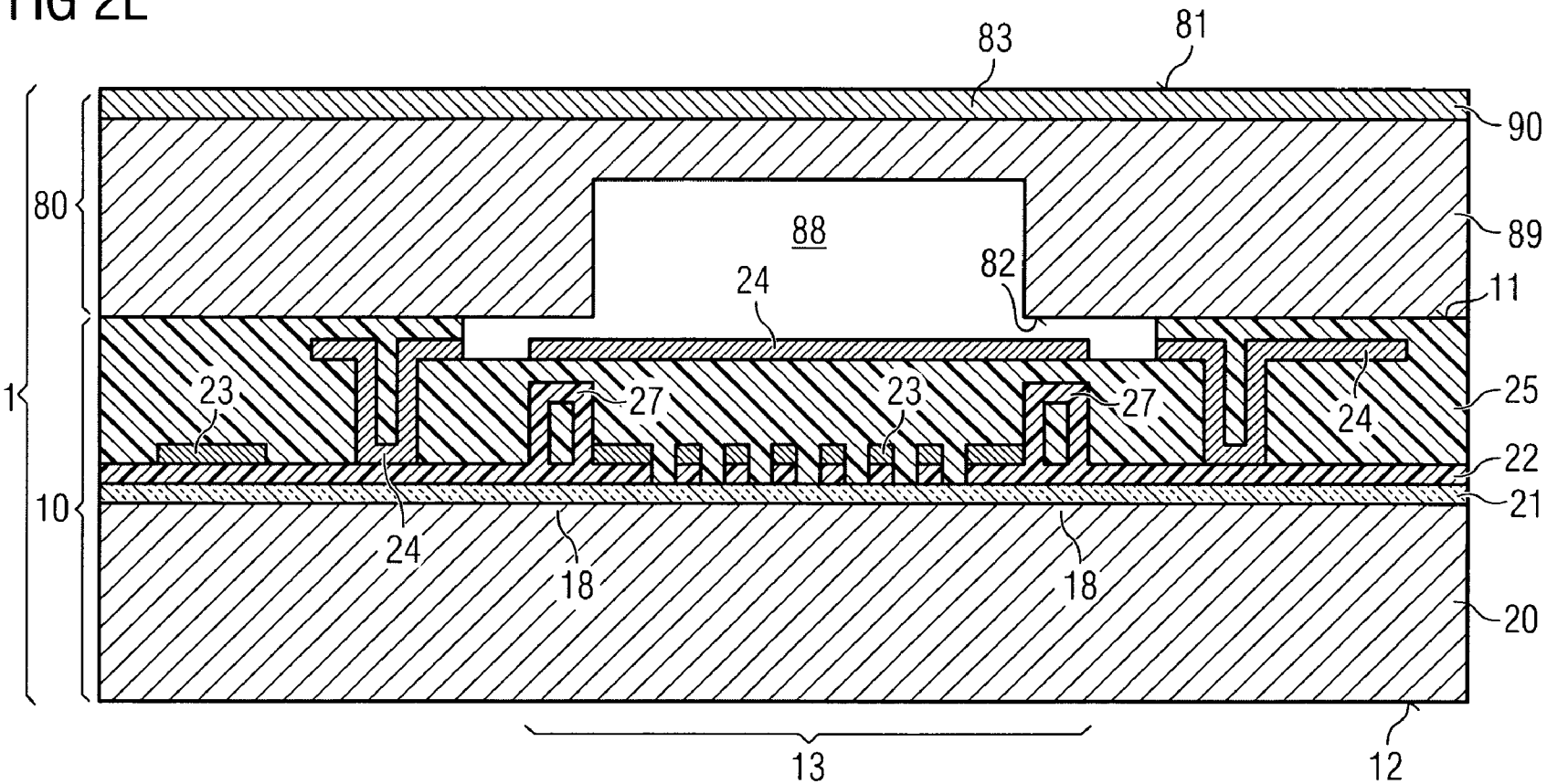

FIG. 2L shows the stack arrangement 1 in which the first main face 11 of the first semiconductor body 10 is connected to the second main face 82 of the second semiconductor body 80. For connection, a wafer bonding process is used. The wafer bonding process corresponds to a fusion bonding process and is carried out at low temperatures. To prepare for wafer bonding, the two surfaces which are to be brought together are activated using a plasma. The connection process therefore takes place without adhesive and avoids possible long-term problems such as outgasing of adhesives or swelling of adhesives in a damp atmosphere.

In one embodiment, not only are the first and second semiconductor bodies 10, 80 connected, as shown in FIG. 2K, but also a first wafer comprising a plurality of first semiconductor bodies 10 and a second wafer comprising a plurality of second semiconductor bodies 80. The result is then a stack arrangement 1 which comprises a plurality of microphone arrangements.

Alternatively, the wafer bonding process used may be a bonding process with an auxiliary layer, or adhesive bonding. In this case, a polymer layer may be used as the auxiliary layer. In one alternative embodiment, a eutectic bonding method is used.

Figure 2M:
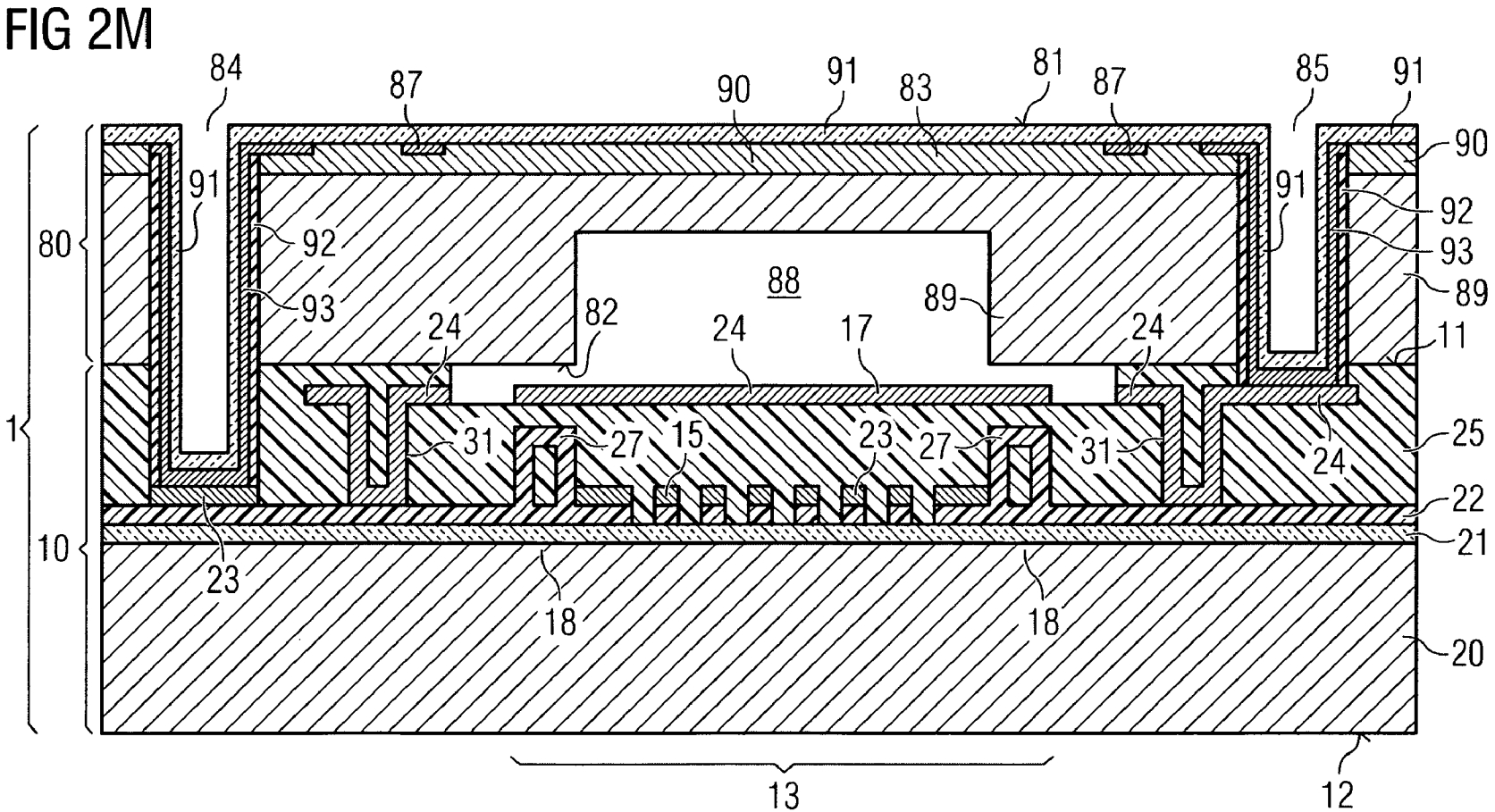

FIG. 2M shows the stack arrangement 1 after the processes for producing the plated-through holes 84, 85 have been carried out. To produce the two plated-through holes 84, 85, recesses are made in the second semiconductor body 80 and through individual layers of the first semiconductor body 10 as far as the first and second conductive layers 23, 24. After the etching operation, an insulator layer 92 is deposited on the walls of the plated-through hole 84, 85. The insulator layer 92 is removed from the bottom of the plated-through holes 84, 85. A metallization layer 93 is deposited over the insulator layer 92. The metallization layer 93 of the first plated-through hole 84 is in electrical contact with the first conductive layer 23 at the bottom of this plated-through hole. This produces good resistive contact between the first electrode 15 and the metallization layer 93. The metallization layer 93 of the second plated-through hole 85 is electrically conductively connected to the second electrode 17. To this end, a conductive connection is made from the second conductive layer 24 to the metallization layer 93. The etching of the recess for producing the plated-through hole 84, 85 therefore stops on the first and on the second conductive layer 23, 24. Electrical connections 87 are provided in the active layer 90. A passivation layer 91 is deposited on the first main face 81 of the second semiconductor body 80 and also covers the walls of the plated-through holes 84, 85.

Figure 2N:
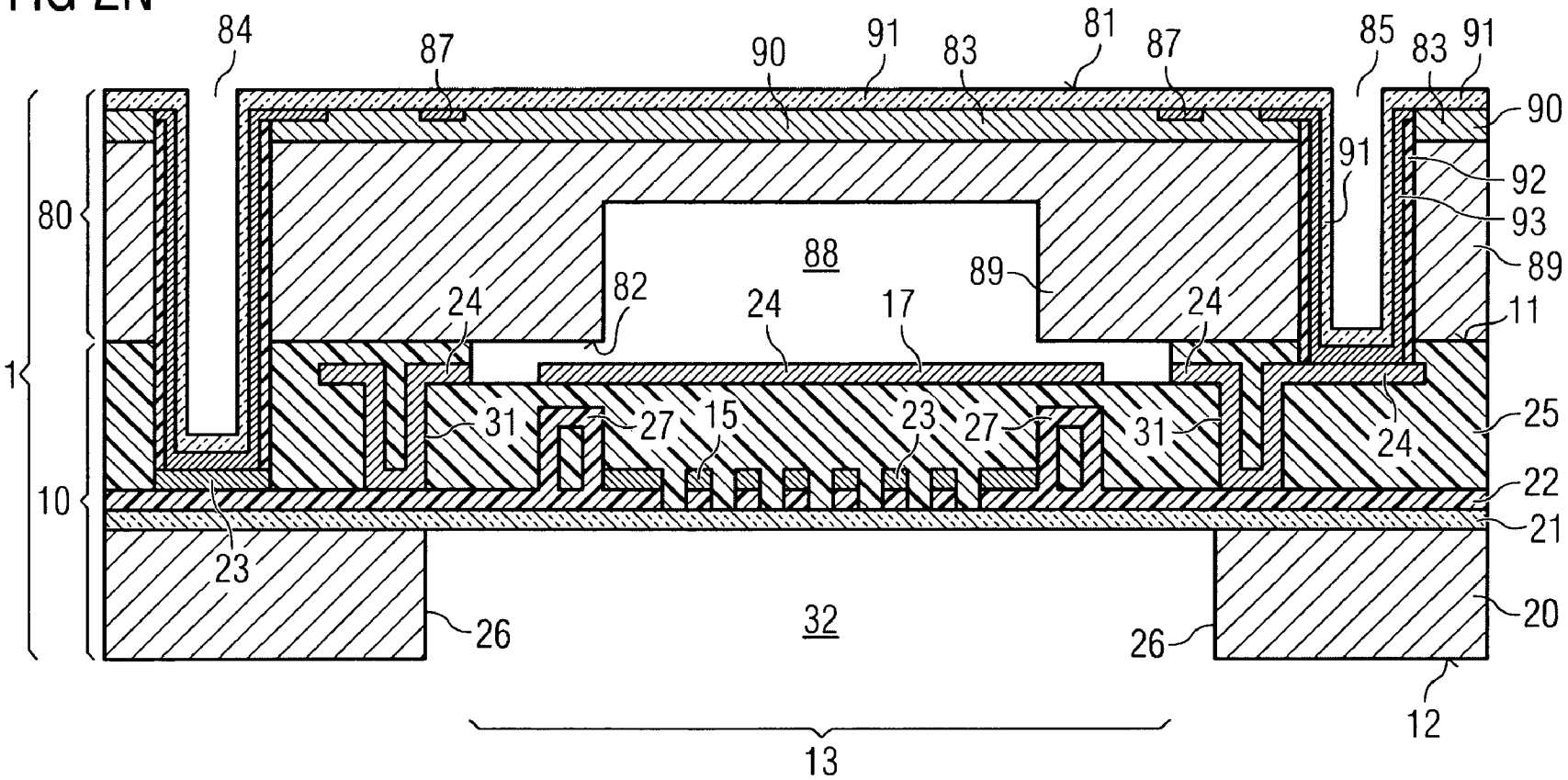
Figure 20:
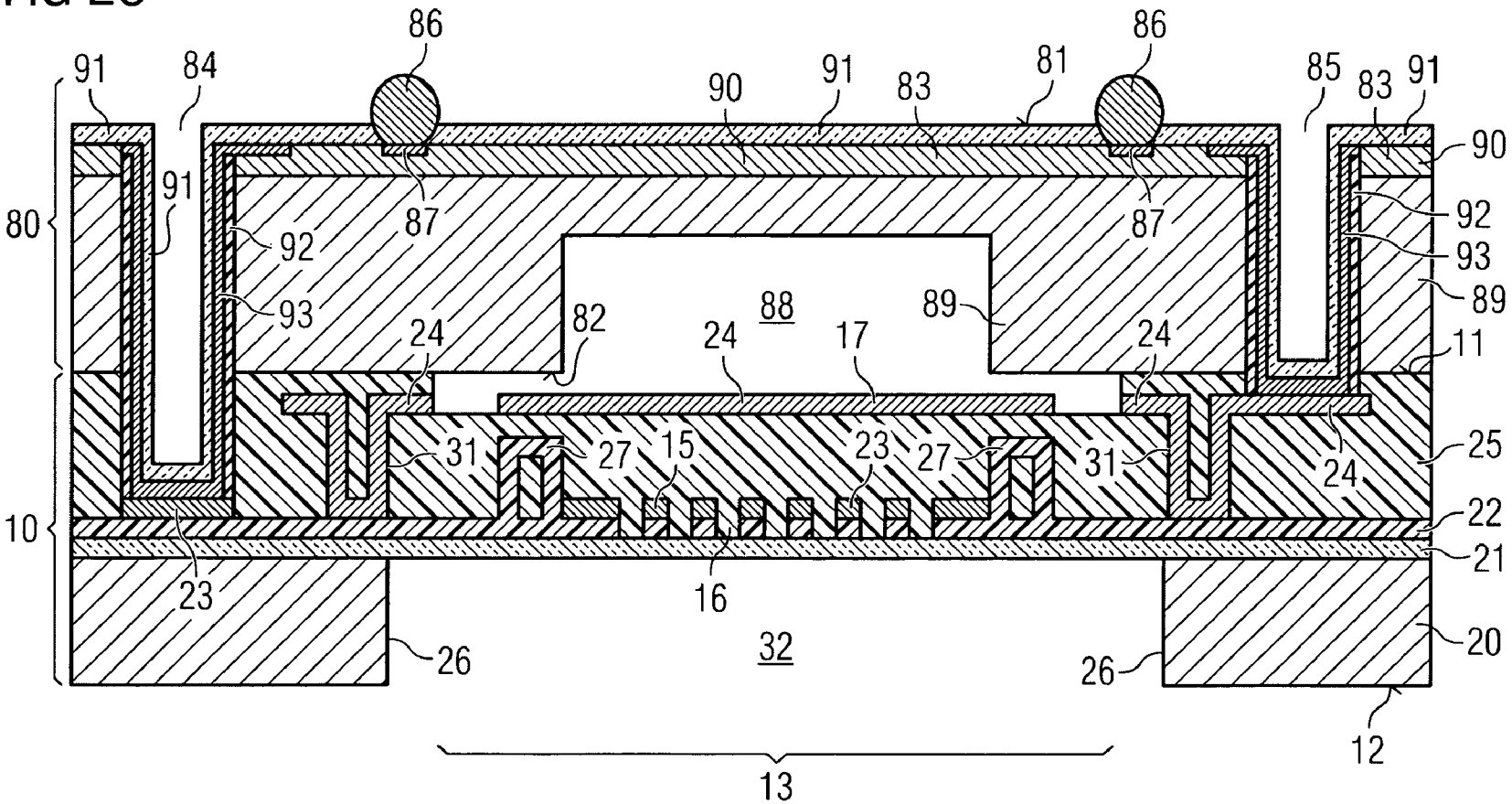

FIG. 2N shows the stack arrangement following etching of the first semiconductor body 10 from the second main face 12. In this etching process, the substrate 20 is removed as far as the first insulator layer 21. The recess 32 can be produced using a dry etching process. Alternatively, the first semiconductor body 10 can first of all be thinned, so that a portion of the substrate 20 is removed. The recess 32 can then be produced in the thinned first semiconductor body 10 using a dry etching process. Alternatively, the recess 32 can be etched using a wet chemical etching process. For this wet chemical etching process, it is possible to use an anisotropic etching operation which uses KOH as etchant, for example. It is not necessary to stop the etching operation exactly at the boundary between the substrate 20 and the first insulator layer 21, since the first insulator layer 21 is removed in a subsequent process step.

FIG. 2O shows the stack arrangement 1 after metal bond balls 86 have been deposited on the connections 87 on the first main face 81 of the second semiconductor body 80. The third, fifth and sixth insulator layers 25, 28, 29 are then removed, so that the recess 14 extends from the first to the second main face 11, 12 of the first semiconductor body 10. The etchant used is ammonium fluoride, HF for short, as liquid. Alternatively, HF in vaporous form may be used. Advantageously, the third, fifth and sixth insulator layers 25, 28, 29 are made from silicon dioxide, because ammonium fluoride attacks silicon dioxide very well but attacks the second and fourth insulator layers 22, 27, which contain silicon nitride, and the first and second conductive layers 23, 24, which contain polysilicon, only to a small extent. The structure following removal of the sacrificial layers is shown in FIG. 1A. Between the state shown in FIG. 2O and the state shown in FIG. 1A, the second method step is therefore performed, in which sacrificial layers are removed in order to expose the two electrodes 15, 17. FIG. 1A shows the result of this method of production.

The scope of protection of the invention is not limited to the examples given hereinabove. The invention is embodied in each novel characteristic and each combination of characteristics, which includes every combination of any features which are stated in the claims, even if this feature or combination of features is not explicitly stated in the examples.

I claim:

1. A method for producing a microphone arrangement, the method comprising the steps of:

producing a microphone structure using a first semiconductor body;

producing an integrated circuit on a first main face of a second semiconductor body;

connecting the first and second semiconductor bodies to form a stack arrangement such that a second main face of the second semiconductor body faces the first semiconductor body, and connecting the first main face of the second semiconductor body to a support; and producing a plated-through hole in an area between the first main face and the second main face of the second semiconductor body, wherein the plated-through hole connects a connection on the first main face of the second semiconductor body to a connection on the microphone structure, and wherein the microphone structure comprises a capacitive structure for detecting sound which comprises first and second electrodes, and freely suspending said first and second electrodes.

2. A method for producing a microphone arrangement, the method comprising the steps of:

producing a microphone structure using a first semiconductor body;

producing an integrated circuit on a first main face of a second semiconductor body;

connecting the first and second semiconductor bodies to form a stack arrangement such that a second main face of the second semiconductor body faces the first semiconductor body, and connecting the first main face of the second semiconductor body to a support, wherein the microphone structure has a capacitive structure for detecting sound and comprises a first electrode and a second electrode.

wherein the first electrode is a stiff electrode and the second electrode is a flexible electrode, and wherein the second electrode is configured to oscillate and has a thickness less than a thickness of the first electrode.

3. The method as claimed in claim 2, further comprising producing a plated-through hole in an area between the first main face and the second main face of the second semiconductor body.

4. The method as claimed in claim 2, further comprising producing a recess in the second semiconductor body on the second main face.

5. The method as claimed in claim 2, further comprising exposing the first and the second electrode of the microphone structure using a first method step to remove an insulator layer and using a second method step to remove a further insulator layer.

6. The method as claimed in claim 2, further comprising:

providing a first wafer which comprises a plurality of first semiconductor bodies;

providing a second wafer which comprises a plurality of second semiconductor bodies; and connecting the first and second wafers to form a stack arrangement which comprises a plurality of microphone arrangements.

7. A microphone arrangement comprising a stack arrangement which comprises:

a first semiconductor body having a microphone structure;

a second semiconductor body having a first main face on which an integrated circuit is arranged, and a second main face which faces the first semiconductor body; and a support on which the second semiconductor body is arranged, the first main face of the second semiconductor body facing the support, wherein the second semiconductor body comprises a plated-through hole from the first to the second main face, and wherein the plated-through hole connects a connection on the first main face of the second semiconductor body to a connection on the microphone structure, and wherein the microphone structure comprises a capacitive structure for detecting sound which comprises first and second electrodes which are freely suspended.

8. A microphone arrangement comprising a stack arrangement which comprises:

a first semiconductor body having a microphone structure;

a second semiconductor body having a first main face on which an integrated circuit is arranged, and a second main face which faces the first semiconductor body; and a support on which the second semiconductor body is arranged, the first main face of the second semiconductor body facing the support, wherein the microphone structure comprises a capacitive structure for detecting sound which comprises:

a first electrode which is freely suspended, is in the form of a stiff electrode and has recesses; and a second electrode which is freely suspended, is in the form of a flexible electrode and has a lesser thickness than the first electrode.

9. The microphone arrangement as claimed in claim 8, wherein the first semiconductor body comprises:

a first main face;

a second main face; and a recess which extends in an area of the first semiconductor body from the first main face to the second main face of the first semiconductor body.

10. The microphone arrangement as claimed in claim 8, wherein the second semiconductor body comprises a plated-through hole from the first to the second main face.

11. The microphone arrangement as claimed in claim 10, wherein means for electrically connecting connections on the first main face to connections on the support is arranged on the first main face of the second semiconductor body.

12. The microphone arrangement as claimed in claim 8, wherein the second semiconductor body comprises a recess which is arranged on the second main face of the second semiconductor body and opposite the microphone structure.

13. The microphone arrangement as claimed in claim 8, wherein the microphone structure comprises a stop which is arranged in an area between the first and the second electrode, which is permanently connected to at most one of the two electrodes and which is configured to stipulate a minimum distance d between the two electrodes.

14. The microphone arrangement as claimed in claim 8, wherein the first and second main faces of the first semiconductor body have the same length L as the first and second main faces of the second semiconductor body, and the first and second main faces of the first semiconductor body have the same width B as the first and second main faces of the second semiconductor body.

* * * * *

UNITED STATES PATENT AND TRADEMARK OFFICE

CERTIFICATE OF CORRECTION

PATENT NO. : 8,199,963 B2
APPLICATION NO. : 11/973224
DATED : June 12, 2012
INVENTOR(S) : Franz Schrank It is certified that error appears in the above-identified patent and that said Letters Patent is hereby corrected as shown below:

On the Title Page, Item (75) should read

(75) Inventor: Franz Schrank, ~~Handelssr~~ Graz (AT)

Signed and Sealed this
Tenth Day of December, 2013

Margaret A. Focarino

Margaret A. Focarino
*Commissioner for Patents of the United States Patent and Trademark Office*